US005655268A

United States Patent [19]

Keyaki et al.

[11] Patent Number: 5,655,268

[45] Date of Patent: Aug. 12, 1997

[54] BUTTON-SUBSTITUTE FASTENING DEVICE

[75] Inventors: Keiichi Keyaki, Macon, Ga.; Hideyuki Matsushima; Hitomi Minato, both of Toyama, Japan

[73] Assignee: YKK Corporation, Tokyo, Japan

[21] Appl. No.: 714,213

[22] Filed: Sep. 16, 1996

[30] Foreign Application Priority Data

Sep. 14, 1995 [JP] Japan ..... 7-237262

[51] Int. Cl.[6] ..... A44B 1/00; A44B 18/00

[52] U.S. Cl. ..... 24/114.9; 24/104; 24/306; 24/442

[58] Field of Search ..... 24/114.9, 114.6, 24/306, 442, 129, 119, 304, 104, 93, 114.4, 114.05, 66.1, 66.11

[56] References Cited

U.S. PATENT DOCUMENTS

| | | | |
|---|---|---|---|
| 2,214,030 | 9/1940 | Pereles | 24/114.9 |
| 2,748,517 | 6/1956 | Berkis | 24/114.9 |
| 3,453,696 | 7/1969 | Mates | 24/306 |
| 3,851,357 | 12/1974 | Ribich et al. | 24/306 |
| 3,940,873 | 3/1976 | Lawless | 24/44.2 |
| 5,048,160 | 9/1991 | Goodrich et al. | 24/114.6 |

*Primary Examiner*—Victor N. Sakran
*Attorney, Agent, or Firm*—Hill, Steadman & Simpson

[57] ABSTRACT

A button-substitute fastening device for use with a companion surface fastener member, comprises: a generally-C-cross-section support body molded of thermoplastic synthetic resin and having substantially parallel first and second plates integrally joined at their one ends by a connecting portion; a multiplicity of engaging elements standing upright on an outer surface of the second plate and adapted for engagement with engaging elements of the companion surface fastener member; the first plate having on its outer surface an arbitrary ornamental design; and a pull-up tab integrally projecting outwardly from the connector in parallel to the first and second plates.

6 Claims, 3 Drawing Sheets

BUTTON-SUBSTITUTE FASTENING DEVICE

BACKGROUND OF THE INVENTION

1. Field of the Invention

This invention relates to a synthetic resin fastening device as a substitute for the conventional snap-type button or the conventional ordinary-type button.

2. Description of the Related Art

Sheet-type fastening devices are currently known from, for example, Japanese Utility Model Publication No. Sho 62-98510 and Japanese Patent Laid-Open Publication No. Hei 7-194413. Some of the conventional fastening devices are of the type in which one half part of a plate-like sheet is a surface fastener member of fibers while the other half part is a flat sheet of fibers, or others are of the type in which a surface fastener member of fibers is adhered to a half part of a single substrate sheet of synthetic resin or natural leather. In use, the resulting sheet is attached to a garment by sewing along its peripheral edge as mounted astride of the edge of an opening of the garment with the engaging surface of the surface fastener member exposed outside.

However, if the conventional fastening device is to be obtained directly from an ordinary woven or knit cloth of fibers, it is required that the surface fastener portion and the ordinary woven or knit cloth are simultaneously woven or knitted, and further the whole surface of the fastening device except the surface fastener member as disclosed in the above-mentioned publications needs to be provided with a design or symbol. Therefore it is inevitable to increase the number of manufacturing steps so that meticulous preparatory works cannot be avoided. Further, when it is to be attached to a garment by sewing or gluing, the fastening device must be folded with the orientation of the design or symbol in order, which requires high sewing accuracy and strict precision of manufacturing process such as cutting, which have to be done by well-experienced workpersons. This meticulous manufacturing process would necessarily reflect on the increase of cost of production.

SUMMARY OF THE INVENTION

It is therefore an object of this invention to provide a button-substitute fastening device which is easy to position during setting with respect to a garment, to attach to the garment by sewing or gluing and to handle after attached and which can be manufactured simply and inexpensively.

According to this invention, the above object is accomplished by a button-substitute fastening device for use with a companion surface fastener member, comprising: a generally-C-cross-section support body molded of thermoplastic synthetic resin and having substantially parallel first and second plates integrally joined at their one ends by a connecting portion; a multiplicity of engaging elements standing upright on an outer surface of the second plate and adapted for engagement with engaging elements of the companion surface fastener member; the first plate having on its outer surface an arbitrary ornamental design; and a pull-up tab of the synthetic resin integrally projecting outwardly from the connecting portion in parallel to the first and second plates.

The engaging elements may be integrally formed on the outer surface of the second plate or may be integral part of a woven or knit substrate sheet of which back surface is attached to the outer surface of the second plate.

Preferably, each of the engaging elements is in the form of a hook composed of a stem portion and a curved engaging portion extending from an end of the stem portion perpendicularly to the connecting portion. Alternatively, each of the engaging elements may be in any other form, e.g. a mushroom shape and a palm-tree shape.

Further, it is preferable that a part of the pull tab is a recess or a through hole in view of the operativity of the fastening device.

DETAILED DESCRIPTION OF THE PREFERRED EMBODIMENTS

Figure 1:
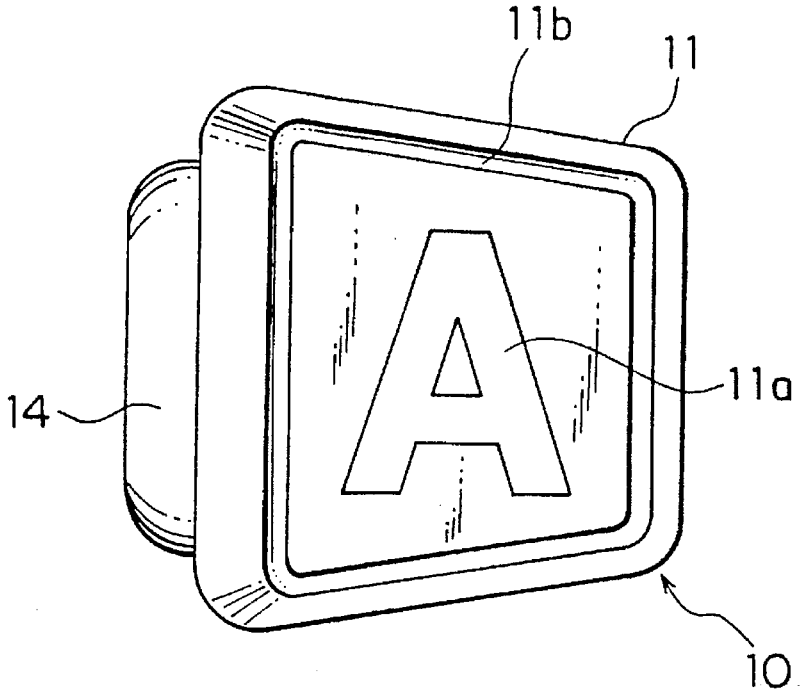
FIG. 1 is a front view showing a button-substitute fastening device according to a typical embodiment of this invention.
Figure 2:
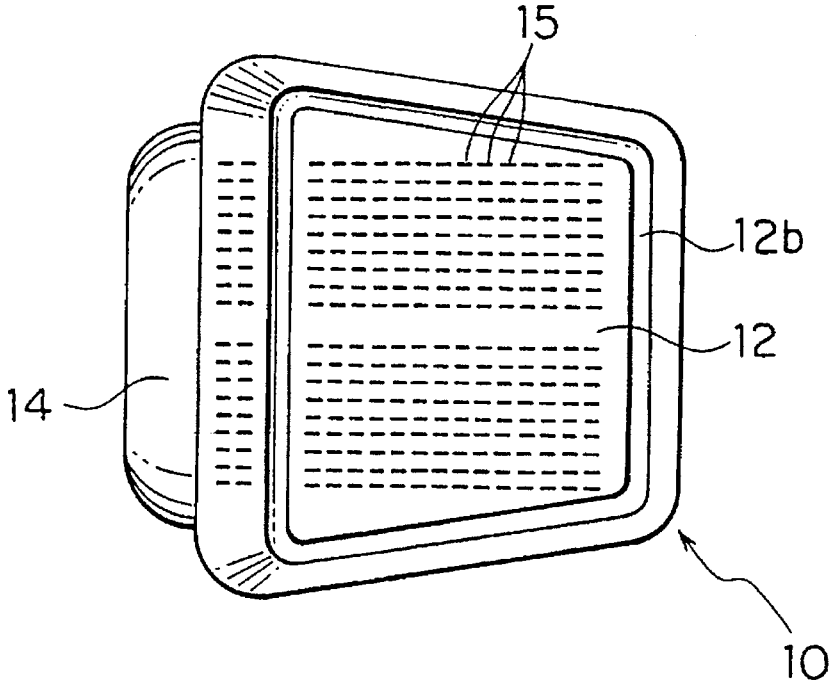
FIG. 2 is a rear view of the fastening device of FIG. 1.
Figure 3:
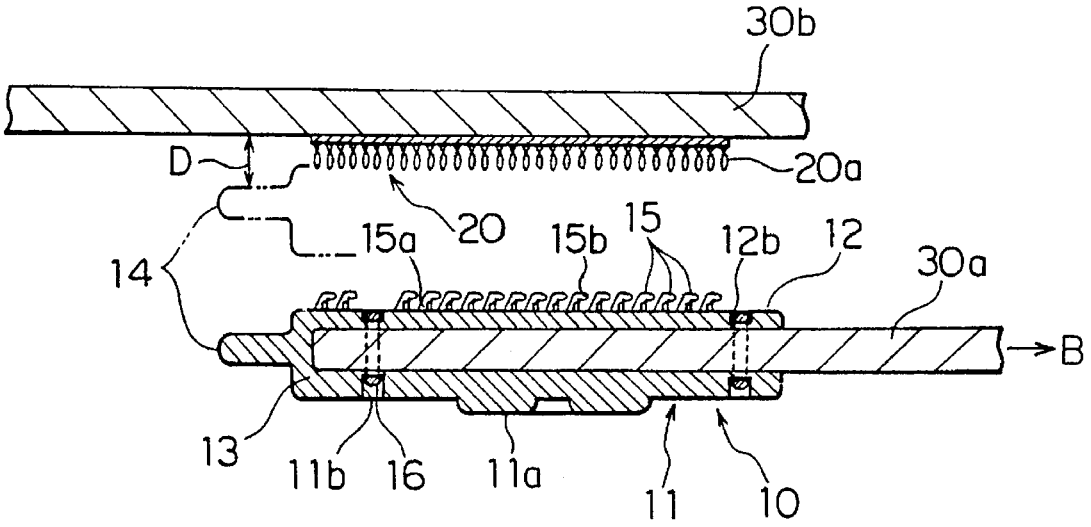
FIG. 3 is a fragmentary cross-sectional view of a garment to which the fastening device is attached, showing the operation of the fastening device.

Preferred embodiments of this invention will now be described in detail below with reference to the accompanying drawings. FIG. 1 is a front view of a button-substitute fastening device according to a first embodiment of the invention. FIG. 2 is a rear view of the fastening device. FIG. 3 is a fragmentary cross-sectional view showing the manner in which the fastening device is used.

The fastening device 10 includes a generally-C-cross-section molded support body composed of substantially parallel first and second plates 11, 12, which are integrally jointed at their one ends by a connecting portion 13. In the illustrated example, though the first and second plates 11, 12 have a common shape, the first plate 11 is larger in thickness than the second plate 12. However, in an alternative form, the thickness of the first and second plates 11, 12 may be the same. The fastening device 10 further has a pull-up tab 14 projecting outwardly from the connecting portion 13, in parallel to the first and second plates 11, 12. The space between the first and second plates 11, 12 is determined arbitrarily according to the thickness of an attaching portion of a garment to which the fastening device 10 is to be attached.

The first plate 11 has on its outer surface an ornamental design or symbol 11*a*. Although it is preferable to be formed simultaneously with the molding of the support body, the design 11*a* may be formed by welding or printing after the support body has been molded. The first plate 11 further has in the peripheral edge of its outer surface a continuous groove 11*b* along which the first plate 11 is to be sewn to the garment. Although the groove 11*b* may be omitted as long as the first plate 11 has such a thickness as not to hinder the sewing operation, it is preferable to form at least a small groove so that the workperson can confirm the sewing line without difficulty.

On the other hand, the second plate 12 has a multiplicity of engaging elements 15 in rows on its outer surface (the rear side of the fastening device 10) as shown in FIG. 2. As shown in FIGS. 2 and 3, the engaging elements 15 are formed not only in an area enclosed with the sewing line on the outer surface of the second plate 12, but also in an edge of the second plate 12 outside the sewing line. Alternatively, the engaging elements 15 may be formed only in the area enclosed with the sewing line. In this embodiment, as shown in FIG. 3, each of the engaging elements 15 is in the form of a hook composed of a stem portion 15*a* standing upright from an outer surface of the second plate 12 and a curved engaging portion 15*b* extending outwardly from the upper end of the stem portion 15*a*. In the illustrated example, all of the engaging portions 15*b* project in a common direction. Alternatively, the directions of the engaging portions 15*b* may be reversed in each pair of adjacent rows. Since the individual engaging portions 15*b* extend in a direction opposite to the direction in which the pull-up tab 14 projects, the degree of strength of engagement with a multiplicity of loops 20*a* of a companion surface fastener member 20 would be maximal with respect to one direction opposite to the direction in which the engaging portions 15*b* extend. The second plate 12 also has in the peripheral edge of its outer surface a groove 12*b* along the sewing line and corresponding to the groove 11*b* of the first plate 11.

The fastening device 10 of this embodiment can be molded simply in a single process such as by injection molding. Specifically, the fastening device 10 can be molded simply on an injection mold that comprises a non-illustrated fixed die having cavities for molding the contour of the first plate 11, the ornamental design 11*a* and part of the connecting portion 13, a non-illustrated movable die having cavities for molding the second plate 12, the engaging elements 15 and the remaining part of the connecting portion 13, and a plate-like insertion die of a predetermined thickness to be inserted between the fixed die and the movable die. Since the respective cavities of each of the hook-shape engaging elements 15 cannot be engraved in the inside surface of a single die due to its unique shape, the die is a composite form of a number of thin die plates having in their end surfaces whole or part of the cavities and placed one over another as a laminate. Further, although the engaging elements can be removed directly from the hook-shape cavities using a non-illustrated separator, such as an ejector pin, after molded, they may be removed simply by separating the plural thin plates in a thickness direction using suitable means.

Figure 4:
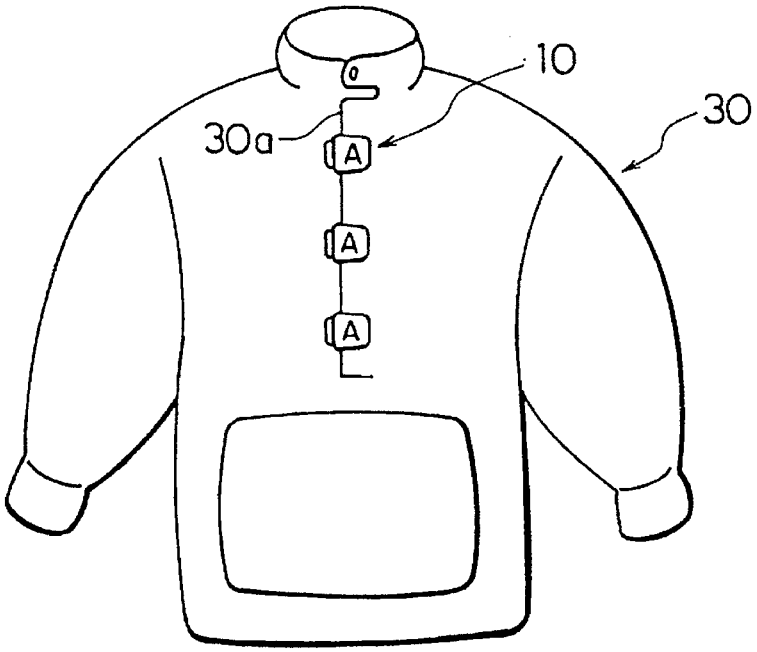
FIG. 4 shows an exterior appearance of a garment to which the fastening device is attached.

For attaching the fastening device 10 of this embodiment to a garment, the fastening device 10 is set in a predetermined position so as that the pull-up tab 14 is at the outer side of the garment while the surface on which the engaging elements 15 project is at the inner side thereof as shown in FIG. 3, e.g. it is set on an upper front edge 30*a* of a front part of the a ski wear 30 with the first and second plates 11, 12 astride of the upper front edge 30*a* of the ski wear front part as shown in FIG. 4, and then the plates 11, 12 are sewn along the groove 11*b*, 12*b* using a sewing thread 16. Gluing with an adhesive agent may be substituted for this sewing. Even during this gluing, the groove 11*b* is preferable to be formed for a reason described below. On the other hand, the companion surface fastener member 20 having a multiplicity of loops 20*a* for engagement with the hook-shape engaging elements 15 of the fastening device 10 is attached to a lower front edge 30*b* of the front part of the garment at a position corresponding to the fastening device 10 by means of sewing or gluing, as shown in FIG. 4.

FIG. 4 shows an exterior appearance of the ski wear 30 to which the fastening device 10 of this embodiment and the companion surface fastener member 20 (not shown in FIG. 4) are attached. In use, as the first plate 11 of the fastening device 10 is pressed toward the corresponding companion fastener member 20, the fastening device 10 and the companion surface fastener member 20 are coupled together to close the front part of the ski wear 30. At that time, since all of the engaging portions 15*b* of the hook-shape engaging elements 15 are oriented in the direction in which the front part of the ski wear 30 is to spread, the individual loop 20*a* acts perpendicularly to the stem portion 15*a* of the corresponding hook-shape engaging element 15, namely, in such a direction that the degree of engaging strength would be maximal. Therefore, even when a strong external force is exerted on the front part of the ski wear 30 in the spreading direction, the fastening device 10 is free from being easily removed from the companion surface fastener member 20.

Further, since there is defined a gap D between the pull-up tab 14 of the fastening device 10 and the lower front edge of the ski wear front part when the fastening device 10 is disposed in a closing posture as indicated in phantom line of FIG. 3, the user can easily insert his finger into the gap D to peel the fastening device 10 off the companion surface fastener member 20, facilitating the removing operation. In other words, if the user pulls the pull-up tab 14 up the direction of peeling the fastening device 10 (downwardly in FIG. 3), the fastening device 10 would tend to be bent along the grooves 11*b*, 12*b* due to their reduced thickness less than the other part of the first and second plates 11, 12 so that the separation of the hook-shape engaging elements 15 from the loops 20*a* is facilitated.

Figure 5:
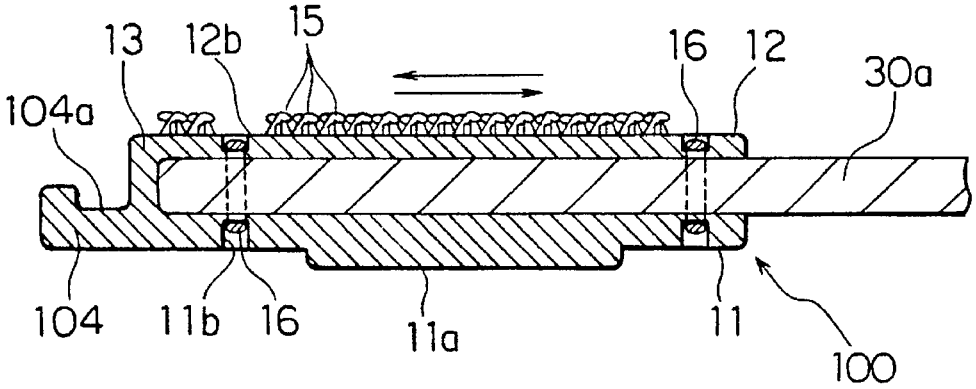
FIG. 5 is a cross-sectional view showing the manner in which a button-substitute fastening device according to another embodiment of this invention is attached.
Figure 6:
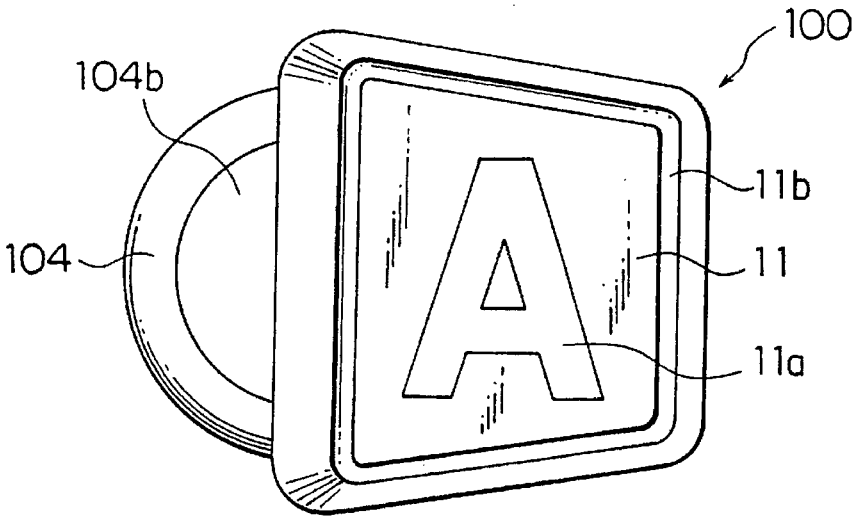
FIG. 6 is a front view showing a modification of a pull-up tab of the fastening device of this invention.

FIG. 5 is a cross-sectional view showing a button-substitute fastening device 100 as attached to the upper front edge 30*a* of the ski wear front part, according to another embodiment of this invention in this embodiment, the engaging portions of the hook-shape engaging elements 15 arranged in adjacent rows are oriented in opposite directions. Further, a modified pull-up tab 104 projecting from the connecting portion 13 has in its outer surface a recess 104*a*. Alternatively, a through hole 104*b* may be substituted for the recess 104*a* as shown in FIG. 6.

Given that the engaging portions of the hook-shape engaging elements 15 in adjacent rows are oriented in opposite directions as mentioned above, it is possible to secure an adequate degree of engaging strength in either direction even when an external force in the spreading direction as indicated arrows in FIG. 5 is exerted on the front part of the ski wear 30. Further, having the recess 104*a* or the through hole 104*b*, the pull-up tab 104 is easy to grip so that opening and closing of the front part of the ski wear 30 can be performed reliably and simply.

Figure 7:
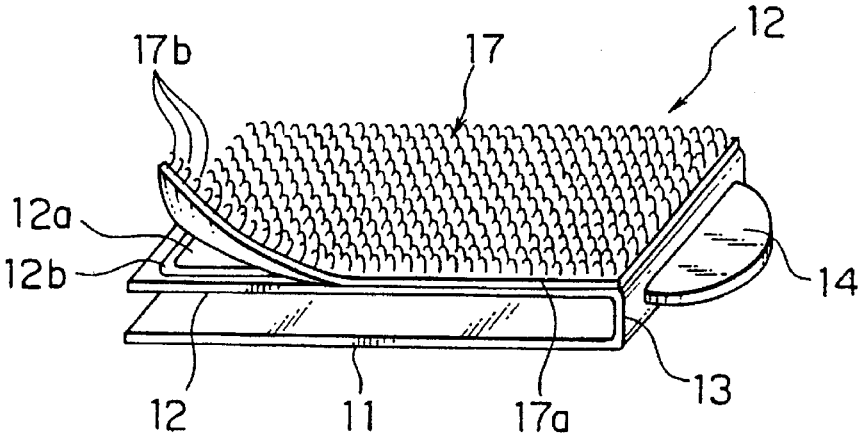
FIG. 7 is a perspective view of a button-substitute fastening device according to still another embodiment of this invention, showing a surface fastener member partly peeled.

FIG. 7 shows still another embodiment of this invention. This embodiment is similar to the foregoing embodiments except that the outer surface 12*a* of the second plate 12 is flat through its entire area except the groove 12*b* and that an ordinary surface fastener member 17 having a woven or knit substrate sheet 17*a* of fibers and a multiplicity of hook-shaped engaging elements 17*b* of ordinary monofilament woven or knitted in the substrate sheet 17*a* so as to project from its one surface is attached to the flat outer surface 12*a* of the second plate 12 by, for example, gluing with an adhesive agent.

The fastening device 10, 100 of this invention may be applied not only to a garment such as a ski wear, but also to shoes or a bag such as a knapsack.

As is apparent from the foregoing description, according to this invention, since the support body of the fastening device 10, 100 is molded of thermoplastic synthetic resin in a unitary form, a product stable in shape and excellent in fashionability with a desired form and a desired design can be obtained inexpensively in a single molding process. More particularly, since the first and second plates 11, 12 are joined at their one ends by the connecting portion 13 in parallel to each other during the molding, it is possible to mount the fastening device 10, 100 on a garment orderly in a correct position without difficulty. Further, since the pull-up tab 14, 104 of the fastening device 10, 100 is integrally formed with and projects outwardly from the connecting portion 13 of the support body, easy opening and closing operations of the fastening device 10, 100 can be achieved. Having the recess 104*a* or through hole 104*b*, the pull-up tab 14, 104 can be handled with increased easiness.

What is claimed is:

1. A button-substitute fastening device for use with a companion surface fastener member, comprising:

(a) a generally-C-cross-section support body molded of thermoplastic synthetic resin and having substantially parallel first and second plates integrally joined at their one ends by a connecting portion;

(b) a multiplicity of engaging elements standing upright on an outer surface of said second plate and adapted for engagement with engaging elements of the companion surface fastener member;

(c) said first plate having on its outer surface an arbitrary ornamental design; and (d) a pull-up tab of the synthetic resin integrally projecting outwardly from said connecting in parallel to said first and second plates.

2. A button-substitute fastening device according to claim 1, wherein said engaging elements are integrally formed on the outer surface of said second plate.

3. A button-substitute fastening device according to claim 1, wherein said engaging elements are integral part of a woven or knit substrate sheet of which back surface is attached to the outer surface of said second plate.

4. A button-substitute fastening device according to claim 1, wherein each of said first engaging elements is in the form of a hook composed of a stem portion and a curved engaging portion extending from an end of said stem portion perpendicularly to said connecting portion.

5. A button-substitute fastening device according to claim 1, wherein a part of said pull-up tab is a recess.

6. A button-substitute fastening device according to claim 1, wherein a part of said pull-up tab is a through hole.

* * * * *